US009463565B2

(12) United States Patent
Nagasaka et al.

(10) Patent No.: US 9,463,565 B2
(45) **Date of Patent: *Oct. 11, 2016**

(54) RECHARGEABLE ELECTRIC TOOL

(71) Applicant: MAKITA CORPORATION, Anjo-shi, Aichi (JP)

(72) Inventors: Hidenori Nagasaka, Anjo (JP); Ryunosuke Kumagai, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 257 days.

This patent is subject to a terminal disclaimer.

(21) Appl. No.: 14/208,698

(22) Filed: Mar. 13, 2014

(65) Prior Publication Data

US 2014/0190718 A1 Jul. 10, 2014

Related U.S. Application Data

(63) Continuation of application No. 13/217,916, filed on Aug. 25, 2011, now Pat. No. 8,708,063.

(30) Foreign Application Priority Data

Sep. 28, 2010 (JP) ..... 2010-217589
Jan. 7, 2011 (JP) ..... 2011-002143

(51) Int. Cl.
*B25F 5/02* (2006.01)

(52) U.S. Cl.
CPC ..... *B25F 5/02* (2013.01)

(58) Field of Classification Search
CPC ..... B25D 15/00; E21B 4/12; B25F 5/02
USPC ..... 173/29, 176, 178, 171, 170, 217, 216; 310/47, 50
See application file for complete search history.

(56) References Cited

U.S. PATENT DOCUMENTS

| | | | | |
|---|---|---|---|---|
| 4,447,749 | A | 5/1984 | Reeb et al. | |
| 5,598,082 | A | 1/1997 | Gilpin et al. | |
| 6,139,359 | A | 10/2000 | Fuhreck et al. | |
| 6,602,122 | B1 * | 8/2003 | Rudolf | B24B 23/005 451/344 |

(Continued)

FOREIGN PATENT DOCUMENTS

| | | | |
|---|---|---|---|
| EP | 1 382 421 | A2 | 1/2004 |
| EP | 1 674 213 | A1 | 6/2006 |
| JP | A-2005-169532 | | 6/2005 |
| JP | 2006-205284 | A | 8/2006 |
| JP | A-2009-78322 | | 4/2009 |
| WO | WO 01/05559 | A2 | 1/2001 |

OTHER PUBLICATIONS

Oct. 20, 2015 Office Action issued in Japanese Application No. 2015-022453.

(Continued)

*Primary Examiner* — Nathaniel Chukwurah
(74) *Attorney, Agent, or Firm* — Oliff PLC

(57) ABSTRACT

The present invention provides a rechargeable electric tool in which a battery pack detachably mounted to a mounting part, which is formed lower than an opening provided at a housing, wherein a seal member is held in the housing to seal between the opening and the battery pack mounted to the mounting part. A projection projecting toward the opening side is provided at the seal member, and a passing hole that penetrates the projection and the seal member and allows a lead line connecting an electric component accommodated on the opening side in the housing to the battery pack to pass therethrough is formed.

6 Claims, 8 Drawing Sheets

(56) References Cited

U.S. PATENT DOCUMENTS

| | | | | |
|---|---|---|---|---|
| 6,729,414 | B2 * | 5/2004 | Cooper | B25F 5/02 173/216 |
| 7,121,362 | B2 * | 10/2006 | Hsu | B25F 5/02 173/170 |
| 7,152,695 | B2 | 12/2006 | Happ et al. | |

OTHER PUBLICATIONS

May 7, 2014 Office Action issued in Japanese Patent Application No. 2011-002143 (with translation).

European Search Report dated Feb. 7, 2014 issued in European Patent Application No. 11179313.9.

* cited by examiner

RECHARGEABLE ELECTRIC TOOL

This is a Continuation Application of application Ser. No. 13/217,916 filed Aug. 25, 2011. The disclosure of the prior application is hereby incorporate by reference herein in its entirety.

BACKGROUND OF THE INVENTION

This application claims the entire benefit of Japanese Patent Application Number 2010-217589 filed on Sep. 28, 2010 and Japanese Patent Application Number 2011-002143 filed on Jan. 7, 2011, the entirety of which is incorporated by reference.

TECHNICAL FIELD

The present invention relates to a rechargeable electric tool in which a battery pack serving as an electric power source is detachably mounted to a mounting part formed lower than openings provided at a housing.

BACKGROUND ART

For example, Japanese Patent Application Laid-Open Publication No. 2009-78322 discloses a rechargeable electric tool in which a battery pack is detachably mounted to a battery mounting part a grip part. The grip part is continuously provided at a housing in which a motor, a driving mechanism, and the like are mounted.

In general, a hole is provided at a housing to expose a trigger of a switch necessary for electrical operations or/and a ventilation hole is provided at the housing to cool a motor in such rechargeable electric tool.

However, for example, in the case where such rechargeable electric tool is left outside during rain, the rainwater or the like occasionally enters the housing from an opening such as the hole or the ventilation hole. In such a case, the rainwater or the like having entered the housing passes through the grip part or the battery mounting part, and then enters a gap between the battery mounting part and the battery pack. Thus, the waterproof property of the battery mounting part and the battery pack has been insufficient.

The present invention has been proposed in view of the foregoing circumstances, and an object thereof is to provide a rechargeable electric tool in which the waterproof property of the battery mounting part and the battery pack is improved.

SUMMARY OF THE INVENTION

According to a first aspect of the present invention, a rechargeable electric tool including a housing having openings, a mounting part that is located lower than the openings and is formed at the housing, a battery pack detachably mounted to the mounting part to serve as an electric power source, and a seal member disposed in the housing to seal between the openings and the battery pack mounted to the mounting part.

According to a second aspect of the present invention, an electric component is accommodated in the opening side of the housing in which openings are provided, and the seal member includes a covering member that closely covers a lead line connecting the electric component to the battery pack and penetrating the seal member, and elastic members that are pressed into and brought into contact with the covering member in the first aspect of the present invention.

According to a third aspect of the present invention, a projection projecting toward the opening side at the seal member, and a passing hole that penetrates the projection and the seal member and allows the lead line connecting the electric component accommodated on the opening side in the housing to the battery pack to pass therethrough is formed in the first aspect of the present invention.

According to a fourth aspect of the present invention, the housing is formed by combining two divided housings with each other. Ribs capable of pressing the seal member may protrude from inner surfaces of the two divided housings while facing each other. The ribs hold the seal member in the housing in a state where the two divided housings are combined with each other in any one of the first to third aspects of the present invention.

According to a fifth aspect of the present invention, the electric component is accommodated on the opening side in the housing, and the seal member is held in the housing in a state where the seal member is twisted around an outer circumferential surface of the electric component in the first aspect of the present invention.

According to a sixth aspect of the present invention, the seal member is held in the housing in a state where the seal member is inclined relative to a bottom surface of the battery pack mounted to the mounting part. A drainage port which communicates inside of the housing to outside thereof is provided near an inclined lower end of the seal member on the opening side in the housing in the first aspect of the present invention.

According to a seventh aspect of the present invention, the electric component is a switch that includes an operation part to control supplying of electric power to a motor that drives an output shaft protruding from a tip end of the housing. The operation part is allowed to be exposed from the opening. The seal member is held in the housing in a state where the seal member is inclined relative to the bottom surface of the battery pack mounted to the mounting part and the inclined lower end is directed toward the opening in the fifth aspect of the present invention.

According to the rechargeable electric tool in the first aspect of the present invention, even if rainwater or the like enters inside of the housing from the openings of the housing, the seal member can prevent the rainwater or the like from entering a gap between the mounting part and the battery pack, and the battery pack. Accordingly, it is possible to improve the waterproof property of the gap and the battery pack.

According to the second aspect of the present invention, the covering member is closely attached to the lead line to cover it. As a result, there is no gap between the covering member and the lead line. Therefore, the rainwater or the like having entered inside of the housing from the openings can be prevented from flowing toward the battery pack along the lead line.

In addition, the elastic members are pressed into and brought into contact with the covering member to seal the surfaces of the covering member facing the elastic members. Accordingly, there is no gap between the covering member and the elastic members, and the rainwater or the like can be prevented from flowing toward the battery pack along the covering member.

According to the third aspect of the present invention, even if the rainwater or the like having entered inside of the housing from the openings passes between an inner surface of the housing and the electric component and flows toward the seal member, the projection of the seal member can prevent the rainwater or the like from flowing back to the opening side, and the rainwater or the like can be prevented from flowing toward the passing hole. Accordingly, the rainwater or the like can be prevented from flowing toward a gap between the mounting part for the battery pack and the battery pack, and the battery pack along the lead line passing through the passing hole.

According to the fourth aspect of the present invention, the seal member is not shaken by being pressed between the both ribs, and the seal member can be prevented from being moved in the housing. Accordingly, the seal member can be preferably positioned in the housing.

According to the fifth aspect of the present invention, the electric component around the outer circumferential surface of which the seal member is twisted is only combined with and accommodated in the housing, so that the seal member can be positioned in the housing. Accordingly, the seal member can be easily positioned.

According to the sixth aspect of the present invention, even if the rainwater or the like having entered the inside of the housing from the openings passes through the housing and flows toward the seal member, the rainwater or the like having reached the seal member can be guided to the drainage port along the inclination of the seal member. Accordingly, the rainwater or the like is discharged to the outside of the housing, and can be prevented from entering the gap and the battery pack.

According to the seventh aspect of the present invention, the rainwater or the like is discharged from the openings to the outside of the housing by using the openings without additionally providing the drainage port in the housing. As a result, the rainwater or the like can be prevented from entering a gap between the mounting part for the battery pack and the battery pack, and the battery pack.

BRIEF DESCRIPTION OF THE DRAWINGS

The above and other aspects, other advantages and further features of the present invention will become more apparent by describing in detail illustrative, non-limiting embodiments thereof with reference to the accompanying drawings.

DETAILED DESCRIPTION OF THE EMBODIMENTS

An Illustrative embodiment of the present invention will be described in detail with reference to the drawings.

First Embodiment

Figure 1:
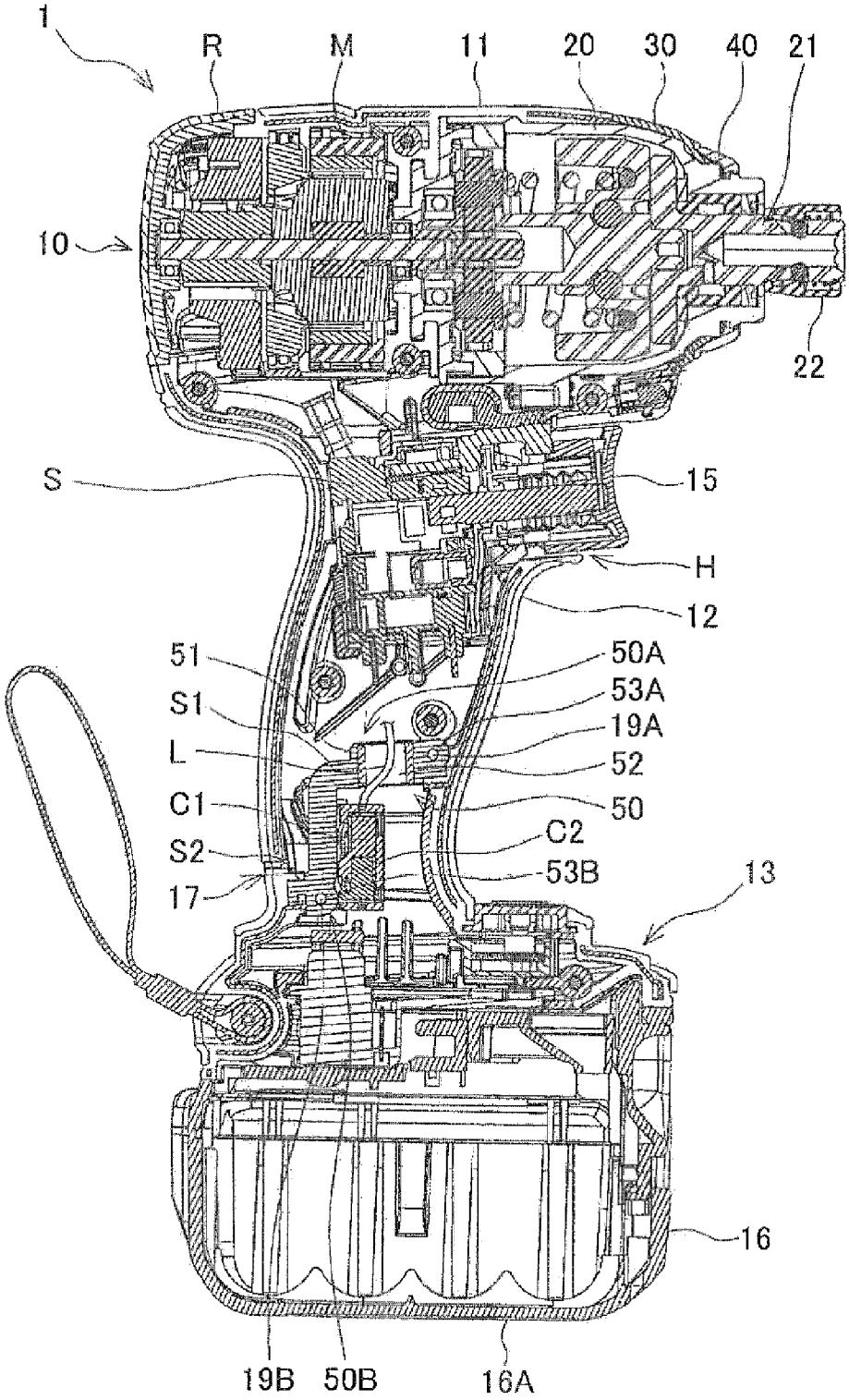
FIG. 1 is a lateral cross-sectional view of main parts of an impact driver according to a first embodiment of the present invention.

A first embodiment of the present invention will be described with reference to FIG. 1 to FIG. 3. As shown in FIG. 1, an impact driver 1 includes a main-body housing 10, a hammer case 20, a seal member 50, and the like.

Figure 2:
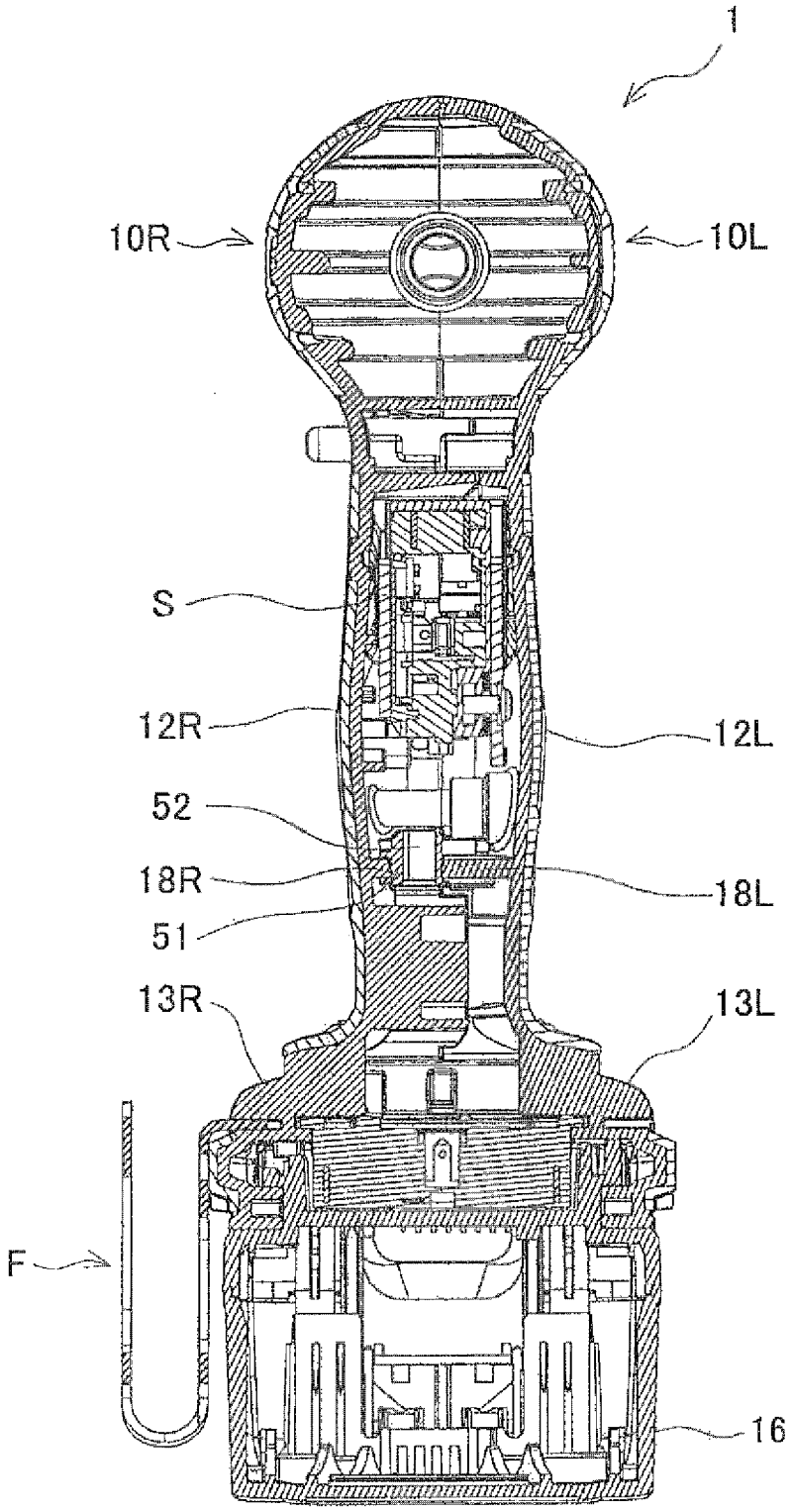
FIG. 2 is a rear cross-sectional view of the main parts of the impact driver according to the first embodiment of the present invention.

As shown in FIG. 1 and FIG. 2, a main-body housing 10 is formed by combination of left and right half housings 10L and 10R made of resin, and includes a body 11, a handle part 12, a battery mounting part 13, and rear cover R. The body 11 is in a tubular shape and extends in the impact driver 1 in the vertical direction of FIG. 1. Inside of the body 11, a motor M is accommodated, and plural inlet ports 14A and outlet ports 14B (see FIG. 3) are provided at positions near the motor M. Further, the rear cover R formed in a tubular shape that is opened toward the body 11 is attached to a rear end of the body 11 by screwing. Plural inlet ports R1 (see FIG. 3) are provided even at the rear cover R, and these inlet ports 14A and R1 are used to draw in cooling air for the motor M in the body 11. The plural outlet ports 14B are used to discharge the cooling air to the outside of the body 11. It should be noted that the main-body housing 10 is an example of a housing of the present invention, the both half housings 10L and 10R are examples of two half housings of the present invention, and the inlet ports 14A and R1 are examples of openings of the present invention.

Figure 3:
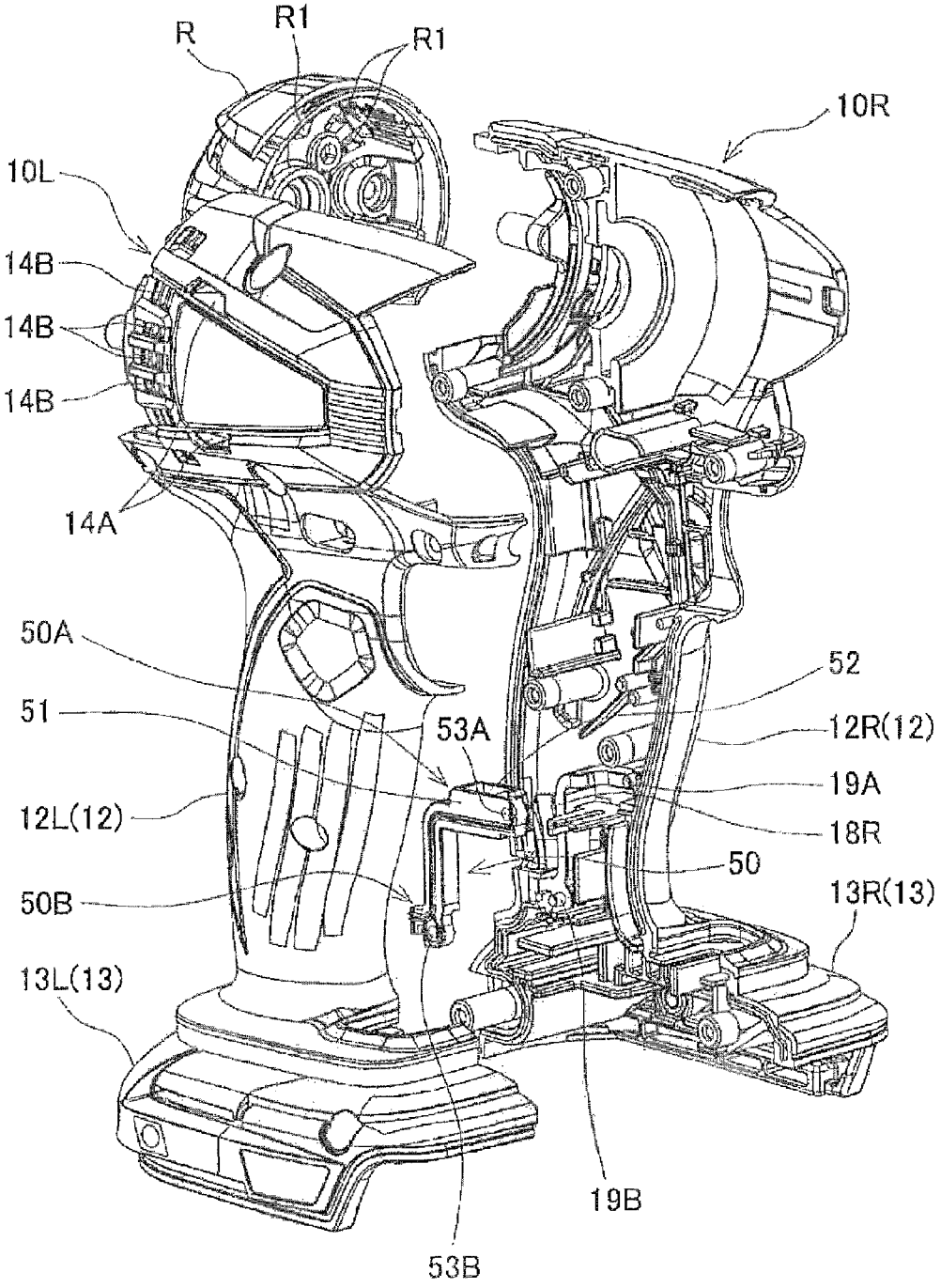
FIG. 3 is an exploded perspective view of left and right half housings and a seal member forming the impact driver according to the first embodiment of the present invention.

As shown in FIG. 1 to FIG. 3, the handle part 12 is formed by combining a left handle part 12L of the left-half housing 10L with a right handle part 12R of the right-half housing 10R. The handle part 12 extends from the body 11 so as to form a substantially T-shape when viewed from the lateral side of the impact driver 1. Inside of the handle part 12, a box-like switch S having a trigger 15 is accommodated at an upper position relative to the seal member 50 in the vertical direction of the impact driver 1. In addition, the handle part 12 is provided with a drainage port 17 at the base of the handle part 12, namely, at a position near a boundary between the handle part 12 and the battery mounting part 13. The drainage port 17 can be communicated inside of the handle part 12 with the outside thereof. The position where the switch S is accommodated and the position where the drainage port 17 is provided in the handle part 12 correspond to the side where the inlet ports 14A and R1 are located with the seal member 50 serving as a boundary. It should be noted that the positions inside of the handle part 12 corresponding to the side where the inlet ports 14A and R1 are located are examples in the housing on the opening side of the present invention.

As shown in FIG. 2 and FIG. 3, a rib 18L protrudes from an inner surface of the left handle part 12L, and a rib 18R protrudes from an inner surface of the right handle part 12R. Each of the both ribs 18L and 18R is formed in a moderate S-shape in accordance with the lateral shape of the seal member 50. In a state where the left and right half housings 10L and 10R are combined with each other, the rib 18L faces the rib 18R in the handle part 12 in the vertical direction of FIG. 2. A cylindrical protrusion 19A protrudes from the rib 18R. The protrusion 19A is provided so as to face a position near a front end of an upper curved part 50A of the S-shape of the seal member 50 on a surface of the rib 18R facing the seal member 50. In addition, a cylindrical protrusion 19B protrudes from the rib 18R. The protrusion 19B is provided so as to face a position near a rear end of a lower curved part 50B of the S-shape of the seal member 50 on a surface of the rib 18R facing the seal member 50.

The battery mounting part 13 is formed by combining a left battery mounting part 13L of the left-half housing 10L with a right battery mounting part 13R of the right-half housing 10R. This battery mounting part 13 is formed on the lower side relative to the inlet ports 14A and R1 in the vertical direction of the impact driver 1, namely, at a lower end of the handle part 12. A terminal stage is accommodated in the battery mounting part 13, and a battery pack 16 formed in a substantially rectangular solid shape is detachably mounted to the terminal stage. The battery pack 16 is a rechargeable electric power source. The trigger 15 is pushed into the inside of the handle part 12 to turn on the switch S, so that the battery pack 16 supplies electricity to the motor M. Further, a hook F (see FIG. 2) used to hang the impact driver 1 on a belt of a worker is swingably attached to a left lateral surface of the battery mounting part 13 when viewed from the backside. It should be noted that the impact driver 1 is an example of a rechargeable electric tool of the present invention, and the battery mounting part 13 is an example of a mounting part of the present invention. In addition, the trigger 15 is an example of an operating part of the present invention.

The hammer case 20 is made of metal (for example, aluminum), and is combined with the front side (right direction of FIG. 1) of the body 11. Inside of the hammer case 20, a hammering mechanism and an anvil 21 are accommodated. The anvil 21 is rotatably supported by a bearing in the hammer case 20, and projects from a tip-end surface of the hammer case 20. A chuck 22 is provided at a tip end of the anvil 21, so that a tip-end tool can be mounted. The hammering mechanism converts the rotation of the motor M into rotational hammering force to be transmitted to the tip-end tool. It should be noted that the anvil 21 is an example of an output shaft of the present invention.

A cover 30 is mounted at a part exposed from the body 11 on the front outer circumference of the hammer case 20. A bumper 40 is combined with a front end of the cover 30 and is mounted at the exposed part. The cover 30 and the bumper 40 prevent the front outer circumference of the hammer case 20 from being exposed.

The seal member 50 is arranged between the switch S and the battery pack 16 in the handle part 12. In other words, the seal member 50 is located between the opening s including inlet ports 14A, R1 and an opening H used for exposing the trigger 15 from the handle part 12, and the battery pack 16. Accordingly, the seal member 50 can seal between the side where the inlet ports 14A, R1 and the opening H are located and the side where the battery pack 16 is provided in the handle part 12. The seal member 50 is made of elastic material such as rubber, has a thickness in the horizontal direction of the handle part 12, and each of the lateral surfaces of the seal member 50 is formed in a moderate S-shape.

As shown in FIG. 1 and FIG. 3, the seal member 50 is configured in such a manner that an upper surface of the upper curved part 50A forming the S-shape serves as an inclined surface (upper inclined surface) S1. The inclined surface S1 is inclined upward in the front direction relative to a bottom surface 16A of the battery pack 16 mounted to the battery mounting part 13. A projection 51 is formed at a front end of the upper inclined surface S1. The projection 51 projects upward (toward the side where the inlet ports 14A and R1 and the opening H are located) from the upper inclined surface S1. A lead-line passing hole 52 penetrating the projection 51 and the upper curved part 50A is formed in the vertical direction of the seal member 50. In addition, a through-hole 53A is formed at a position on the upper-end side (a position on the front side) of the upper curved part 50A in the projection 51. The through-hole 53A is formed in the thickness direction of the projection 51 (seal member 50), and the protrusion 19A can be inserted into the through-hole 53A.

On the other hand, an upper surface of the lower curved part 50B forming the S-shape serves as an inclined surface (lower inclined surface) S2. The inclined surface S2 is inclined downward in the rear direction relative to the bottom surface 16A of the battery pack 16 mounted to the battery mounting part 13. As shown in FIG. 1, the drainage port 17 is located near a lower end of the lower inclined surface S2. In addition, a through-hole 53B is formed at a position on the rear side of the lower curved part 50B. The through-hole 53B is formed in the same direction as the through-hole 53A, and the protrusion 19B can be inserted into the through-hole 53B.

In a state where the left and right half housings 10L and 10R are combined with each other as shown in FIG. 2, the protrusion 19A is inserted into the through-hole 53A, and the protrusion 19B is inserted into the through-hole 53B, so that the rib 18L is pressed into a left lateral surface of the seal member 50, and the rib 18R is pressed into a right lateral surface of the seal member 50. Accordingly, the left and right lateral surfaces of the seal member 50 are elastically deformed to be closely attached to the both ribs 18L and 18R, respectively. At the same time, the seal member 50 is sandwiched and held between the both ribs 18L and 18R in a state where the seal member 50 is fitted into the handle part 12. In a state where the seal member 50 is held in the handle part 12, the seal member 50 is inclined downward toward the rear side of the battery pack 16 relative to the bottom surface 16A of the battery pack 16. It is due to the presence of the upper inclined surface S1 and the lower inclined surface S2.

As shown in FIG. 1, an internal connector C1 is accommodated in the handle part 12 on the battery pack 16-side. A lead line L connected to the internal connector C1 is allowed to pass through the lead-line passing hole 52 to extend from the battery pack 16-side to the side where the inlet ports 14A and R1 and the opening H are located in the handle part 12. The lead line L is electrically connected to the switch S on the side where the inlet ports 14A and R1 and the opening H are located in the handle part 12. A lead line (not shown) for supplying electricity to the motor M is electrically connected between the switch S and the motor M. In addition to the lead line L, a is communication line (not shown) and the like are allowed to pass through the lead-line passing hole 52 without a gap.

An external connector C2 is accommodated on the battery pack 16-side in the handle part 12 in a state where the external connector C2 is coupled to the internal connector C1. A lead line (not shown) connected to the external connector C2 extends toward the lower end side (battery mounting part 13) of the handle part 12 to be electrically connected to the terminal stage. In the illustrated impact driver 1, the switch S and the battery pack 16 are electrically connected to each other through the both connectors C1 and C2, the lead line L, and the like. In the embodiment, non-waterproof connectors are used as the both connectors C1 and C2. Accordingly, the both connectors C1 and C2 are small in size as compared to waterproof connectors.

Therefore, the both connectors C1 and C2 can be accommodated in a narrow space in the handle part 12 surrounded by the seal member 50, an inner surface of the handle part 12 on the battery pack 16-side, and the battery mounting part 13. It should be noted that the switch S is an example of an electric component of the present invention, and the lead-line passing hole 52 is an example of a passing hole of the present invention.

For example, even if the impact driver 1 of the embodiment is left outside in a standing posture while the bottom surface 16A of the battery pack 16 is brought into contact with the ground, and rainwater or the like enters from the inlet ports 14A and R1 and the opening H (see FIG. 1), the rainwater or the like can be prevented from entering the battery pack 16 and the like in the following manner. The rainwater or the like having entered from the inlet ports 14A and R1 flows down from the inside of the body 11. It flows down toward the seal member 50 and the ribs 18L and 18R through a gap between an inner surface of the handle part 12 and the switch S. At this time, there is no gap between the side where the inlet ports 14A and R1 are located and the battery pack 16-side in the handle part 12 due to the presence of the seal member 50. Thus, the rainwater or the like can be prevented from entering the battery pack 16-side from the side where the inlet ports 14A and R1 are located.

In addition, the rainwater or the like having reached the seal member 50 flows down on the upper inclined surface S1 and the lower inclined surface S2 to be guided to the drainage port 17. Further, the rainwater or the like having reached the ribs 18L and 18R is guided to the drainage port 17 along upper surfaces of the ribs 18L and 18R. Thereafter, the rainwater or the like passes through the drainage port 17 from the inside of the handle part 12 to be discharged to the outside of the handle part 12. In addition, the rainwater or the like having reached the seal member 50 hardly flows back to the side where the inlet ports 14A and R1 are located due to the upward inclination of the upper inclined surface S1, and the projection 51 serves as a barrier against backflow. Thus, the rainwater or the like is prevented from flowing into the lead-line passing hole 52. Further, since the projection 51 projects upward relative to the upper surfaces of the ribs 18L and 18R, the rainwater or the like flowing on the upper surfaces of the ribs 18L and 18R is prevented from flowing into the lead-line passing hole 52 by the projection 51 serving as a barrier. Therefore, the rainwater or the like can be prevented from entering the battery pack 16-side in the handle part 12 along the lead line L and the like allowed to pass through the lead-line passing hole 52. Accordingly, the rainwater or the like is prevented from flowing into the internal connector C1 and the external connector C2 connected to the lead line L, and thus the waterproof property of the both connectors C1 and C2 is improved.

On the other hand, the rainwater or the like having entered from the opening H is also prevented from entering the battery pack 16-side from the side where the inlet ports 14A and R1 and the opening H are located in the handle part 12, as similar to that having entered from the inlet ports 14A and R1. In addition, the rainwater or the like having entered from the opening H is guided to the drainage port 17, as similar to that having entered from the inlet ports 14A and R1. Thereafter, the rainwater or the like is discharged to the outside of the handle part 12. In addition, the rainwater or the like having entered from the opening H is prevented from flowing into the lead-line passing hole 52, as similar to that having entered from the inlet ports 14A and R1. Accordingly, the rainwater or the like having entered from the opening H can be prevented from entering the battery pack 16-side, as similar to that having entered from the inlet ports 14A and R1. It should be noted that the opening H is an example of an opening of the present invention.

Effect of the First Embodiment

In the impact driver 1 of the first embodiment, the seal member 50 seals a portion in the handle part 12 between the inlet ports 14A and R1 and the opening H, and the battery pack 16 mounted to the battery mounting part 13 located lower in the vertical direction of the impact driver 1 than the inlet ports 14A and R1 and the opening H. Thus, even if the rainwater or the like flows down from the inlet ports 14A and R1 toward the handle part 12 through the body 11, or the rainwater or the like enters from the opening H and flows down along an inner surface of the handle part 12, the seal member 50 can prevent the rainwater or the like from entering a gap between the battery mounting part 13 and the battery pack 16, and the battery pack 16. Accordingly, it is possible to improve the waterproof property of the gap and the battery pack 16.

Further, even if the rainwater or the like having entered from the inlet ports 14A and R1 flows down to the seal member 50 from the inside of the body 11 through a gap between an inner surface of the handle part 12 and the switch S, the projection 51 can prevent the rainwater or the like from flowing back to the side where the inlet ports 14A and R1 are located. As a result, the rainwater or the like can be prevented from flowing into the lead-line passing hole 52. In addition, the rainwater or the like having entered from the opening H can be also prevented from flowing back to the side where the inlet ports 14A and R1 and the opening H are located by the projection 51. As a result, the rainwater or the like can be prevented from flowing toward the lead-line passing hole 52. Accordingly, the rainwater or the like can be prevented from entering the battery pack 16-side along the lead line L and the like allowed to pass through the lead-line passing hole 52.

Further, in a state where the left and right half housings 10L and 10R are combined with each other, the seal member 50 is held in the handle part 12 while being sandwiched between the both ribs 18L and 18R. Therefore, the seal member 50 is not shaken by being pressed between the both ribs 18L and 18R, and the seal member 50 can be prevented from being moved in the handle part 12. Accordingly, the seal member 50 can be preferably positioned in the handle part 12.

Furthermore, the drainage port 17 is provided at a position corresponding to the side where the inlet ports 14A and R1 and the opening H are located in the handle part 12. The drainage port 17 is positioned near a lower end of the lower inclined surface S2 of the seal member 50. Therefore, even if the rainwater or the like having entered from the inlet ports 14A and R1 and the opening H flows down in the handle part 12, the rainwater or the like having reached the seal member 50 flows down on the upper inclined surface S1 and the lower inclined surface S2 to be discharged from the drainage port 17 to the outside of the handle part 12. Accordingly, the rainwater or the like having entered from the inlet ports 14A and R1 and the opening H can be prevented from entering the gap and the battery pack 16.

Second Embodiment

Figure 4:
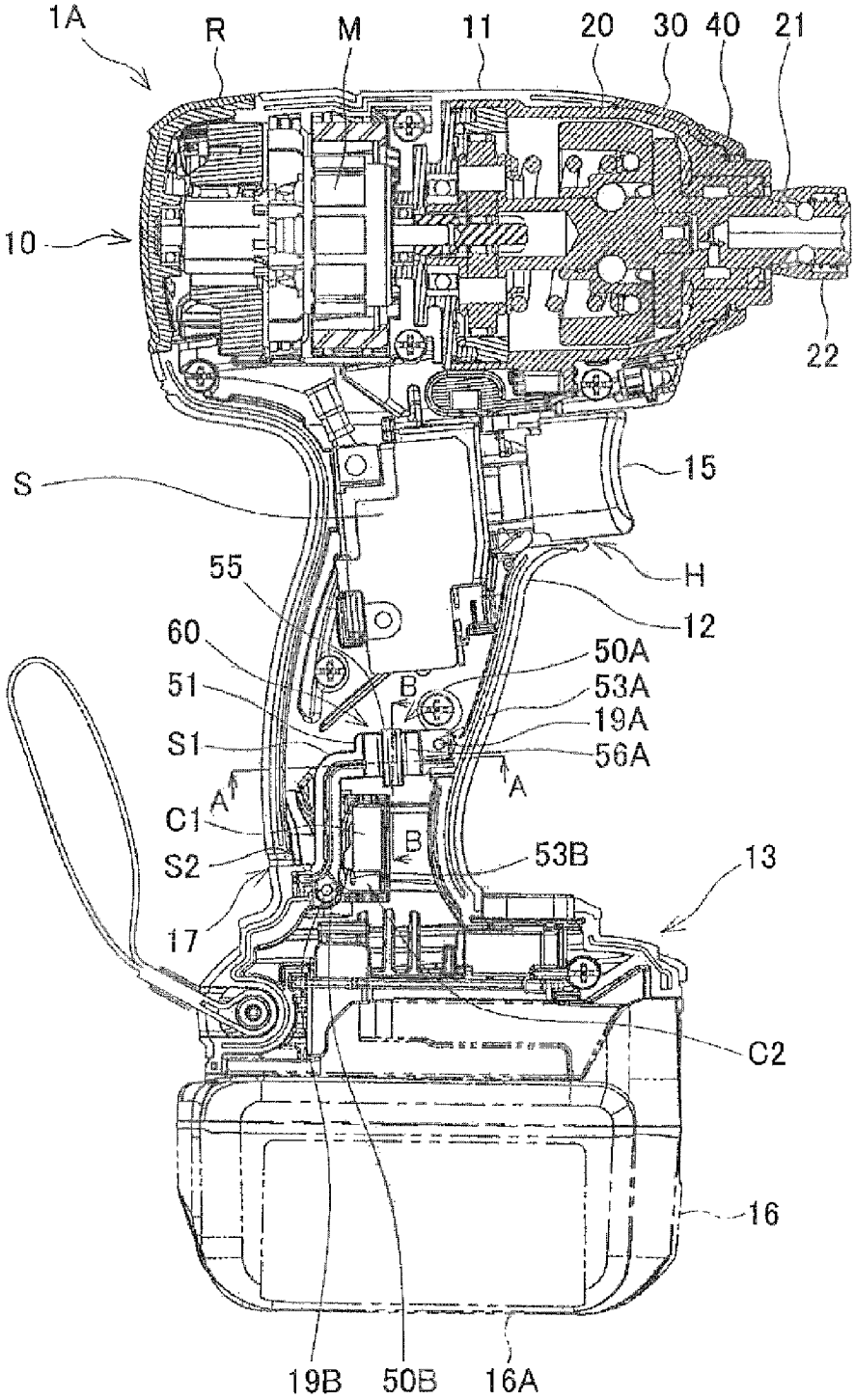
FIG. 4 is a lateral cross-sectional view of main parts of an impact driver according to a second embodiment of the present invention.
Figure 5:
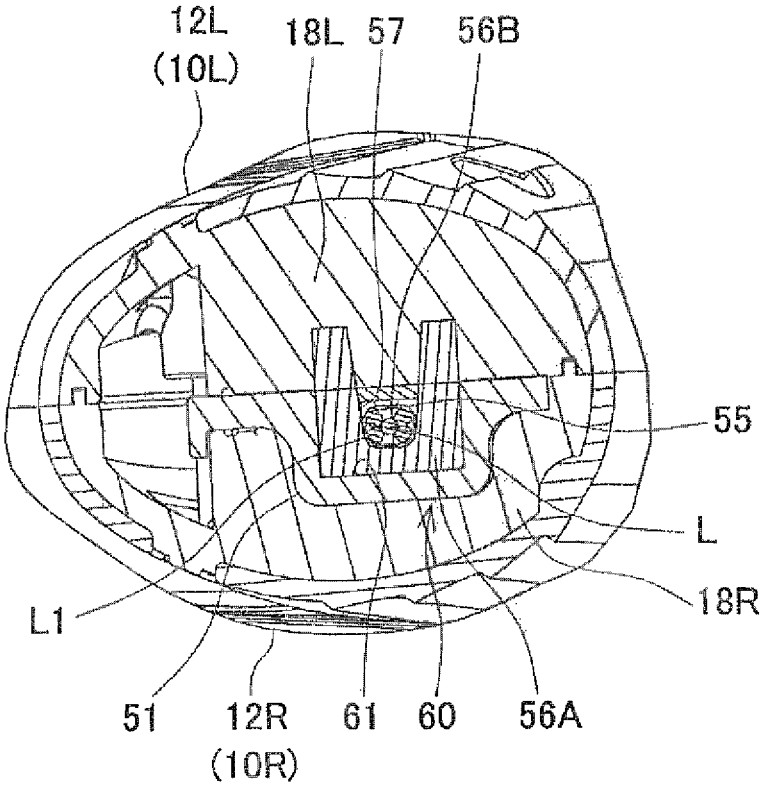
FIG. 5 is a cross-sectional view taken along the line A-A of FIG. 4.
Figure 6:
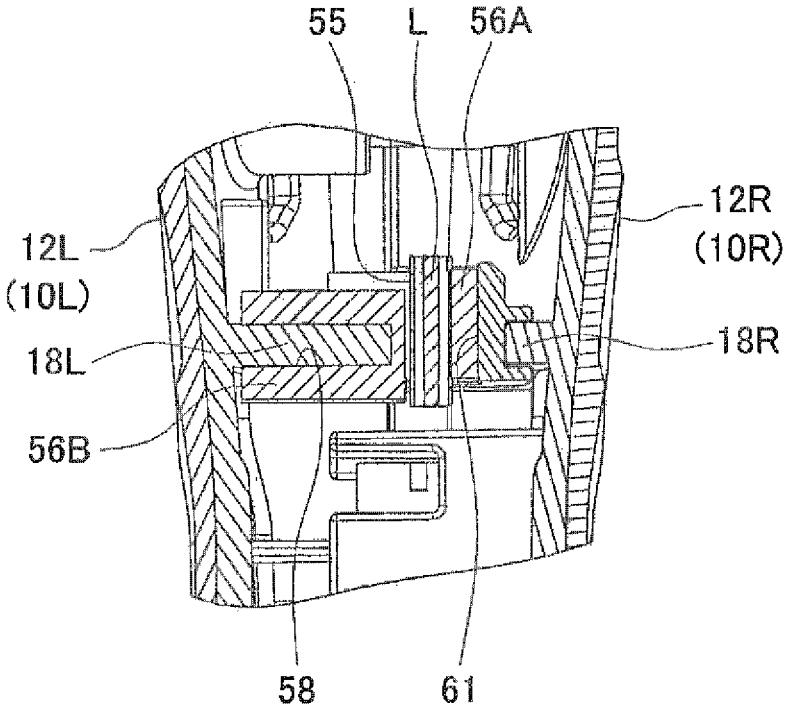
FIG. 6 is a cross-sectional view taken along the line B-B of FIG. 4.

A second embodiment of the present invention will be described with reference to FIG. 4 to FIG. 6. In the second embodiment, the same constitutional elements as those in the first embodiment are given the same reference numerals and the explanations thereof will not be repeated. In addition, the same effects as those in the first embodiment will not be repeated. Further, the lead line L is not illustrated in FIG. 4. However, the lead line L same as that in the first embodiment is also provided in an impact driver 1A of the second embodiment. The impact driver 1A includes a heat-shrinkable tube 55, single-bubble sponges 56 (56A and 56B), and a seal member 60. An inner circumferential surface of the heat-shrinkable tube 55 is coated with an adhesive. The heat-shrinkable tube 55 is heated after being mounted to the lead line L and a communication line L1, so that the heat-shrinkable tube 55 is shrunk and closely attached to the lead line L and the like. Accordingly, as shown in FIG. 5 and FIG. 6, the heat-shrinkable tube 55 covers the lead line L and the communication line L1. At the same time, the adhesive is melted to flow between the lead line L and the communication line L1. Then, the adhesive is hardened after cooling, so that the heat-shrinkable tube 55, the lead line L and the communication line L1 are tightly closed to each other.

The single-bubble sponge 56A includes a concave groove 57 that extends in the vertical direction and is opened on the lateral side. A concave groove 61 extending in the vertical direction of the seal member 60 is formed at a projection 51 of the seal member 60. The single-bubble sponge 56A is fitted into the concave groove 61 in a state where tip-ends of the single-bubble sponge 56A project from the concave groove 61 in the horizontal direction. A concave groove 58 that is opened toward an inner surface of the handle part 12L is formed at a single-bubble sponge 56B whose cross-section is U-shaped as shown in FIG. 6. The single-bubble sponge 56B is formed in a substantially rectangular shape in planar view, and is fitted into the concave groove 57 from the proximal side of the single-bubble sponge 56B.

Before combining the left and right half housings 10L and 10R with each other, the lead line L and the communication line L1 covered with the heat-shrinkable tube 55 are allowed to pass through the concave groove 57 of the single-bubble sponge 56A and to penetrate the seal member 60, so that the switch S and the internal connector C1 are electrically connected to each other. As shown in FIG. 5 and FIG. 6, when the left and right half housings 10L and 10R are combined with each other, the rib 18R is pressed into a right lateral surface of the seal member 60. At the same time, the rib 18L presses the single-bubble sponge 56B into the heat-shrinkable tube 55 in a state where the rib 18L is fitted into the concave groove 58 of the single-bubble sponge 56B. At this time, the rib 18L is closely attached to the single-bubble sponge 56A while deforming the same. As a result, the single-bubble sponge 56A and the single-bubble sponge 56B are pressed into and brought into contact with an outer circumferential surface of the heat-shrinkable tube 55, so that surfaces of the heat-shrinkable tube 55 facing the single-bubble sponge 56A and the single-bubble sponge 56B are sealed. It should be noted that the heat-shrinkable tube 55 is an example of a covering member of the present invention, and the single-bubble sponges 56A and 56B are examples of elastic members of the present invention.

In the second embodiment, even if rainwater or the like reaches the lead line L and the communication line L1 through the inlet ports 14A and R1 and the opening H, the rainwater or the like can be prevented from entering the battery pack 16-side in the following manner. Since there is no gap between the heat-shrinkable tube 55 and the lead line L and the communication line L1, the rainwater or the like flowing toward the heat-shrinkable tube 55 along the lead line L and the communication line L1 neither passes between the heat-shrinkable tube 55 and the lead line L and the like, nor enters the battery pack 16-side in the handle part 12. Further, since the surfaces of the heat-shrinkable tube 55 facing the single-bubble sponge 56A and the single-bubble sponge 56B are sealed, there is no gap between the heat-shrinkable tube 55 and each of the single-bubble sponges 56A and 56B. Thus, the rainwater or the like flowing along the lead line L and the communication line L1 neither passes between the heat-shrinkable tube 55 and each of the single-bubble sponges 56A and 56B, nor enters the battery pack 16-side in the handle part 12.

Effect of the Second Embodiment

In the impact driver 1A of the second embodiment, the heat-shrinkable tube 55 is closely attached to the lead line L and the communication line L1 to cover the lead line L and the like. As a result, there is no gap between the heat-shrinkable tube 55 and the lead line L and the like. Therefore, the rainwater or the like having entered from the inlet ports 14A and R1 and the opening H can be prevented from flowing toward a gap between the battery mounting part 13 and the battery pack 16, and the battery pack 16 from between the heat-shrinkable tube 55 and the lead line L and the like.

In addition, the surfaces of the heat-shrinkable tube 55 facing the single-bubble sponge 56A and the single-bubble sponge 56B are sealed, so that there is no gap between the heat-shrinkable tube 55 and each of the single-bubble sponges 56A and 56B. Therefore, the rainwater or the like can be prevented from flowing toward the gap between the battery mounting part 13 and the battery pack 16 or toward the battery pack 16 from between the heat-shrinkable tube 55 and each of the single-bubble sponges 56A and 56B.

Third Embodiment

Figure 7:
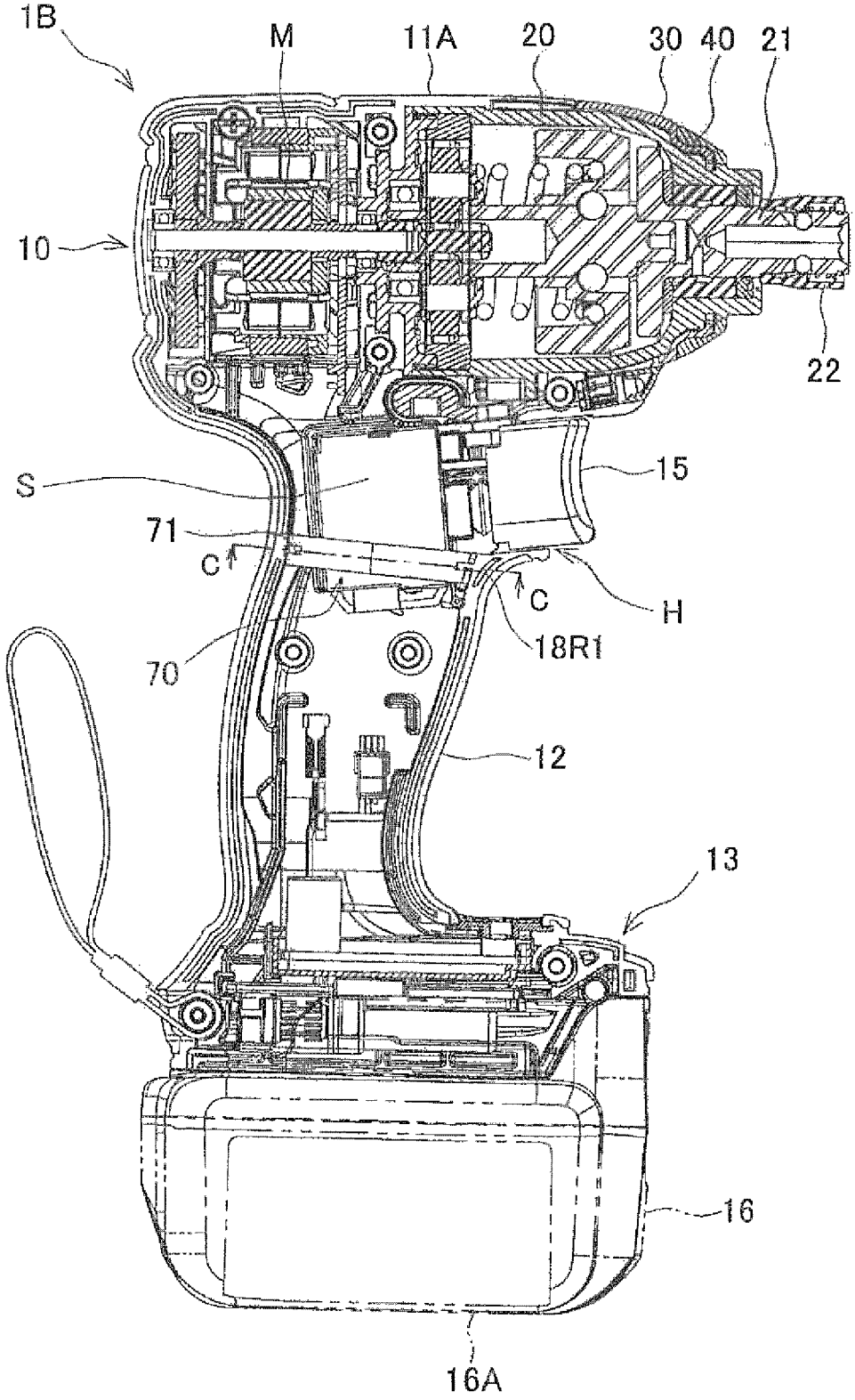
FIG. 7 is a lateral cross-sectional view of main parts of an impact driver according to a third embodiment of the present invention.
Figure 8:
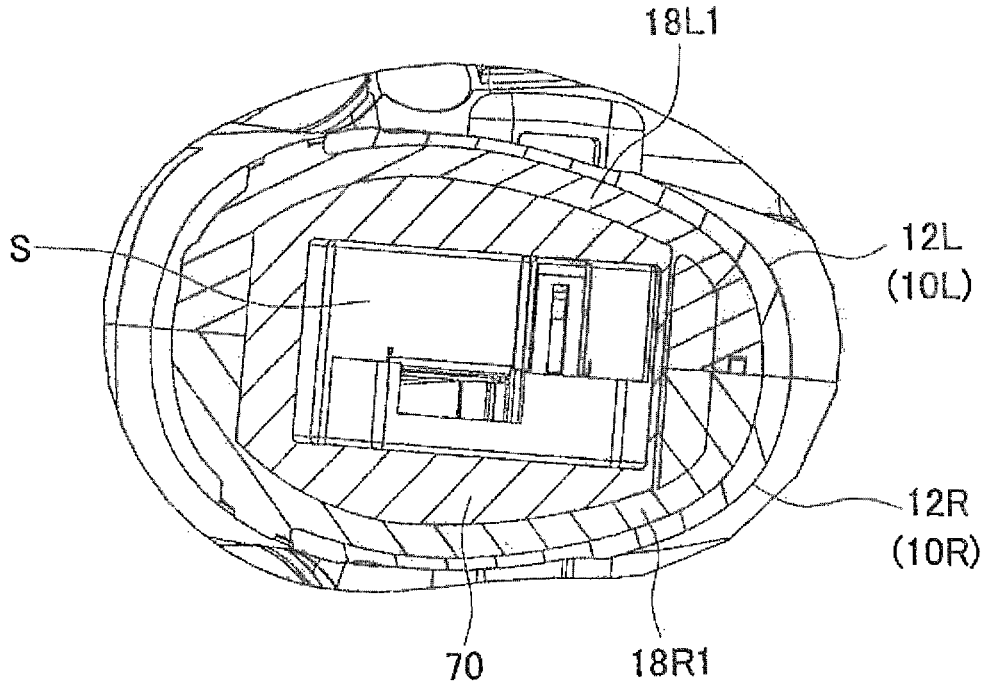
FIG. 8 is a cross-sectional view taken along the line C-C of FIG. 7.

A third embodiment of the present invention will be described with reference to FIG. 7 and FIG. 8. In the third embodiment, the same constitutional elements as those in the first and second embodiments are given the same reference numerals and the explanations thereof will not be repeated. Unlike the first and second embodiments, an impact driver 1B of the third embodiment has a body 11A formed in a tubular shape without providing the rear cover R. The impact driver 1B is provided with a seal member 70. The seal member 70 is made of elastic material such as rubber. As shown in FIG. 7, the seal member 70 is fitted into a position in the handle part 12 between the inlet port 14A and the opening H, and the battery pack 16 in a state where the seal member 70 is twisted around an outer circumferential surface of the switch S. Accordingly, the seal member 70 seals between the side where the inlet port 14A and the opening H are located and the battery pack 16-side in the handle part 12. The seal member 70 is twisted around the outer circumferential surface in a state where the seal member 70 is inclined downward toward the front side of the battery pack 16 relative to the bottom surface 16A of the battery pack 16. A rib guiding grove 71 is provided on the entire circumference of the seal member 70. Further, as shown in FIG. 8, a thin-plate rib 18L1 protrudes across the entire inner circumference of the left handle part 12L, and a thin-plate rib 18R1 protrudes across the entire inner circumference of the right handle part 12R. The ribs 18L1 and 18R1 are arranged on a plane that is inclined downward in the front direction relative to the bottom surface 16A.

When the left and right half housings 10L and 10R are combined with each other, the ribs 18L1 and 18R1 are engaged with the rib guiding groove 71 while the trigger 15 is exposed from the opening H in a state where the seal member 70 is twisted around the outer circumferential surface of the switch S, so that the switch S is accommodated in the handle part 12. Accordingly, the seal member 70 is positioned and held in the handle part 12. At this time, the seal member 70 is arranged in such a manner that its inclined lower end is directed toward the opening H.

In the third embodiment, even if rainwater or the like enters the inside of the handle part 12 through the inlet port 14A and the opening H, the rainwater or the like can be prevented from entering the battery pack 16-side in the following manner. Due to the presence of the seal member 70, there is no gap between the side where the inlet port 14A and the opening H are located and the battery pack 16-side in the handle part 12. Thus, the rainwater or the like cannot enter the battery pack 16-side from the side where the inlet port 14A and the opening H are located. In addition, the rainwater or the like having reached the seal member 70 flows down on an upper surface of the seal member 70 to be guided to the opening H. Thereafter, the rainwater or the like passes through the opening H to be discharged to the outside of the handle part 12. Accordingly, the rainwater or the like cannot enter the battery pack 16-side in the handle part 12.

Effect of the Third Embodiment

In the impact driver 1B of the third embodiment, the seal member 70 is twisted around the outer circumferential surface of the switch S, and the switch S is only accommodated in the handle part 12 while the seal member 70 is engaged with the ribs 18L1 and 18R1 using the rib guiding groove 71, so that the seal member 70 can be positioned in the handle part 12. Accordingly, the seal member 70 can be easily positioned.

Further, unlike the first and second embodiments, the rainwater or the like having entered inside of the handle part 12 through the inlet port 14A and the opening H is discharged from the opening H to outside of the handle part 12 by using the opening H without additionally providing the drainage port 17 in the handle part 12. As a result, the rainwater or the like can be prevented from entering a gap between the battery mounting part 13 and the battery pack 16, and the battery pack 16.

The present invention is not limited to the above-described embodiments, but can be implemented by appropriately changing a part of the configuration within a range without departing from the scope of the present invention. Unlike the first and second embodiments, the shape of each lateral surface of the seal member is not limited to the S-shape, but may be, for example, a shape that is linearly inclined from side where the inlet ports 14A and R1 and the opening H are located toward the battery pack 16-side.

Further, in the case where the shape of each lateral surface of the seal member is linearly inclined, the shape of each rib protruding from the respective handle parts 12L and 12R may be changed to a shape enabling to press each of the linearly inclined lateral surfaces, unlike the above-described embodiments. In addition, the switch S may be accommodated in the handle part 12 by engaging a convex part provided on the entire circumference of the seal member 70 with concave parts provided on the entire circumferences of the both handle parts 12L and 12R, unlike the above-described embodiments. Alternatively, the switch S may be accommodated in the handle part 12 by directly engaging the seal member 70 with the concave parts provided on the entire circumferences of the both handle parts 12L and 12R without providing the convex part at the seal member 70. Further, the present invention may be applied to not only the above-described impact drivers 1, 1A, and 1B, but also an electric tool such as a rechargeable hammer drill.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims.

What is claimed is:

1. An electric power tool comprising:

a body accommodating a motor, the body having a drainage port;

a handle continuously provided with the body;

a terminal provided on the handle;

a battery connectable to the terminal; and a seal member sealing the terminal, the seal member having a shape configured to direct liquid to the drainage port, the handle including a first portion and a second portion, the first portion including a trigger, the first portion extending in a first longitudinal direction, the second portion disposed below the first portion, the second portion configured to connect to the battery, the second portion extending in a second longitudinal direction transverse to the first longitudinal direction, wherein the seal member is disposed on the first portion of the handle.

2. The electric power tool according to claim 1, wherein the handle having a right part and a left part, and the sealing part is sandwiched between the right and left parts.

3. The electric power tool according to claim 2, wherein the seal member is disposed in the handle.

4. The electric power tool according to claim 3, wherein the seal member has an S-shape.

5. The electric power tool according to claim 4, wherein the seal member seals a connector.

6. An electric power tool comprising:

a body accommodating a motor, the body having a drainage port;

a handle continuously provided with the body;

a switch accommodated inside the handle;

a terminal provided on the handle;

a battery connectable to the terminal; and a seal member disposed around an outer circumferential surface of the switch, for sealing the terminal, the seal member having a shape configured to direct liquid to the drainage port.

* * * * *